US006845161B2

(12) United States Patent
Boss

(10) Patent No.: US 6,845,161 B2
(45) Date of Patent: Jan. 18, 2005

(54) SYSTEM AND METHOD FOR PERFORMING ACOUSTIC ANALYSIS OF DEVICES

(75) Inventor: Roland Boss, Guadalajara (MX)

(73) Assignee: Hewlett-Packard Development Company, L.P., Houston, TX (US)

( * ) Notice: Subject to any disclaimer, the term of this patent is extended or adjusted under 35 U.S.C. 154(b) by 211 days.

(21) Appl. No.: 09/862,137

(22) Filed: May 21, 2001

(65) Prior Publication Data

US 2002/0172373 A1 Nov. 21, 2002

(51) Int. Cl.[7] ..... H04R 29/00

(52) U.S. Cl. ..... 381/56; 381/58; 381/59; 73/589; 73/865.9

(58) Field of Search ..... 381/56, 58, 59; 73/589, 865.9

(56) References Cited

U.S. PATENT DOCUMENTS 3,710,615 A * 1/1973 Johnson et al. ..... 73/61.75
4,060,716 A * 11/1977 Pekrul et al. ..... 702/184
5,377,274 A * 12/1994 Meyer ..... 381/59
5,390,248 A * 2/1995 Segan ..... 381/56
5,684,251 A * 11/1997 Arcas et al. ..... 73/589
6,134,968 A * 10/2000 Kunze ..... 73/589

* cited by examiner

*Primary Examiner*—Xu Mei
*Assistant Examiner*—Justin Michalski

(57) ABSTRACT

A system and method are disclosed which utilize robotic analysis of acoustic data captured during operation of a device to evaluate the operation of such device. An acoustic capture sensor is implemented within a device, such as a paper handling device, automobile, or any other device that generates detectable sound as a by-product of its operation. The acoustic capture sensor captures sound produced by the operation of the device and converts the captured sound from analog to digital. The captured sound is communicated to a processor-based device that is operable to process the sound to evaluate the operation of the device. The processor-based device may be communicatively coupled to a data storage device that has empirical sound data stored therein. In this manner, the processor-based device may compare sound captured by acoustic capture sensor(s) within a device with the stored empirical sound data to analyze the device's operation.

19 Claims, 2 Drawing Sheets

SYSTEM AND METHOD FOR PERFORMING ACOUSTIC ANALYSIS OF DEVICES

TECHNICAL FIELD

This invention relates generally to analyzing the operation of devices during, for example, production or post-production diagnostics, and in specific to a system and method that capture sounds generated during operation of a device and utilize such captured sounds to robotically analyze its operation, including as examples determining whether the device is functioning properly and/or identifying specific problems with the device.

BACKGROUND

Many types of devices are produced by manufacturers, and various methods have been developed for testing, troubleshooting, and/or otherwise ensuring the proper operation of such devices. Often, various devices are manufactured as "modules" that are then combined to form a larger system. For example, various paper handling modules, such as modules for sorting, stacking, stapling, etcetera, are commonly combined into a larger system, such as a photocopier. As another example, various automotive modules, such as an engine, transmission, radiator, brake system, etcetera, are commonly combined into a larger system forming an automobile.

Generally, analysis of the operation of devices may include optical analysis. For instance, optical sensors may be utilized in developing a device to enable monitoring of the device's operation, such as detection of movement of internal parts of the device. Consider, for example, a paper handling device, such as a paper sorter, may include various levers and optical switches (sensors) arranged to detect when each lever opens and closes. For instance, as paper travels through the paper handling device, the paper may cause various levers to open and close along the way. More specifically, as the leading edge of a sheet of paper progresses through a segment of the paper handling device, it may lift a lever, which in turn interrupts an optical switch, and as the trailing edge of the sheet passes through the lever, the lever closes, which ends the interruption of the optical switch. Electrical signals may be communicated from the optical sensor to a computer to compute the timing for the sheet passing through the lever. Such optical analysis is typically performed during development stages of a device, rather than production (or manufacturing) and/or post-production stages, to aid a developer in designing devices with proper timing.

During production and/or post-production of a device, various forms of manual analysis of the device's operation may be utilized. For example, at various stages of production of a device, a user may visually inspect the device. Additionally, once the device is completed, a visual inspection of the device may be made during operation to ensure that the device appears to function properly. For some devices, various forms of robotic testing/analysis may also be performed. For instance, software code intended to test the operation of a microprocessor may be loaded for execution by a microprocessor to allow for testing/analysis of the microprocessor.

As described above, some systems are formed by combining various modules. Often, the individual modules are tested/analyzed before being combined into a larger system to ensure that each module satisfies predefined operational criteria established for such module. However, even though each module may satisfy its predefined operational criteria, when combined with other modules to form the larger system, such modules may result in deteriorated performance of the system. For instance, if two modules are near their threshold tolerances for acceptable performance, they may individually be acceptable, but may result in deteriorated performance when combined. For example, a first paper handling module may have a predefined timing criteria that its operation must satisfy, and a second paper handling module may have a different timing criteria that its operation must satisfy. For instance, suppose a first paper handling module must pass a sheet of paper through a particular lever at a rate between 670 milliseconds (ms) and 730 ms. A rate of 700 ms may be the optimum rate for the first paper handling module, but any rate between 670 ms and 730 ms is deemed to be acceptable. A second paper handling module may have a criteria specifying that it must pass a sheet of paper through a particular lever at a rate between 760 ms and 840 ms, with 800 ms being the optimum rate.

Suppose now that one of the first type of paper handling device passes a sheet of paper through the particular lever at a rate of 670 ms (e.g., the lower operational threshold defined for the module) and one of the second type of paper handling module passes a sheet of paper through the particular lever at a rate of 840 ms (e.g., the upper operational threshold defined for the module). Each of the paper handling devices are deemed acceptable because they each satisfy their individual operational criteria. However, once the modules are combined into a larger system, the larger system may not function properly and/or may be unreliable in its operation because each of the modules are at their operational thresholds. Further, the life expectancy of the resulting larger system (i.e., the period of time that it will function properly) may suffer. Thus, such modular testing of devices may fail to give an accurate analysis of the performance of the overall system. Additionally, determining the cause of improper operation of the resulting system may be difficult, especially if operational problems occur sporadically, because each module was individually tested and found to satisfy its predefined operational criteria (e.g., because each individual module was determined to be acceptable, it may be difficult to determine the cause of failure when the modules are combined).

Furthermore, even if analysis, such as the above-described optical analysis to determine the timing of operation of various components (e.g., levers), is performed on the overall system, rather than or in addition to modular analysis, a sufficiently detailed view of the operation of such overall system may not be obtained (or may be very difficult to obtain) through such method of analysis. For instance, within a paper handling device, such optical analysis may be utilized to determine that the timing of such device is outside its predefined range. However, the optical analysis typically fails to identify why such timing is outside of its predefined range. Suppose for instance that a paper handling device includes a lever through which a sheet of paper is to pass within a time range of 670 ms to 730 ms. Further suppose that an optical sensor is utilized to analyze a manufactured one of such paper handling device, from which it is determined that a sheet of paper passes through the lever at a rate of 750 ms. While such optical analysis may show that the device's timing is outside its predefined range, such optical analysis fails to identify whether the incorrect timing is caused by improper operation of the device's motor, too much friction present in the system, or some other cause. Thus, such optical analysis is often of little assistance in determining the root cause of operational problems within a device. Additionally, other forms of analysis, including manual analysis by a technician are often difficult, inefficient, and/or unreliable in determining root cause of operational problems encountered with a device. Many times operational problems occur sporadically within a device. For instance, the above-described optical analysis may detect proper timing within a device for many operational iterations, but the device may fail sporadically. As described above, the optical analysis typically provides no clue as to the cause of the sporadic failure.

Root cause analysis is a problem not only when testing/analyzing devices during the manufacturing stage, but also becomes an issue when operational problems later arise within the devices. For example, a customer may utilize a paper handling device, which over time may begin to encounter operational problems. Determining the cause of such operational problems is often difficult, and such difficulty is often increased in situations where the occurrence of operational problems is sporadic. For instance, the device may appear to operate correctly while a technician is examining its operation, but sporadically encounter performance problems when the technician is not present. A technician is, therefore, sometimes left to guess as to the probable cause of a problem described by a customer and must service the device based on such guess, which may be incorrect, leading to continued performance problems (which may worsen over time) and/or increased cost to the customer. Further, some problems exist in the operation of a device that are not readily noticed by a user when operating the device. Such problems may go unnoticed and continue to worsen or lead to other problems until the device fails to operate properly (in a manner that is noticed by a user). Once the device's operation fails in a manner that is noticeable by a user, the customer may be greatly impacted, whereas if the problem were detected and corrected when initially encountered (at a point in which the problem is not readily noticeably by a user), the device may be serviced to avoid such an impact on the customer.

SUMMARY OF THE INVENTION

The present invention is directed to a system and method which utilize robotic analysis of acoustic data captured during operation of a device to evaluate the operation of such device. According to at least one embodiment, one or more acoustic capture sensors (e.g., microphone(s)) are implemented within a device, such as a paper handling device, automobile, or any other device that generates detectable sound as a by-product of its operation. The acoustic capture sensor captures sound produced by the operation of the device, which may be processed in many different ways to enable evaluation of the device's operation. For instance, a relatively simple timing comparison of the captured sound to empirical sound data may be performed, and/or a full frequential analysis of the captured sound may be performed, as examples. In certain embodiments the analysis may be performed by the acoustic capture sensor (e.g., particularly if the analysis is relatively simple, such as a relatively simple comparison of timings), but in other embodiments the analysis may be performed by an external device communicatively coupled thereto. For instance, in one embodiment, the acoustic capture sensor may convert the captured sound from analog to digital. The captured sound may then be communicated (in digital form) to a processor-based device that is operable to process the sound in order to evaluate the operation of the device. Such processor-based device may be implemented as any suitable acoustic analyzer now known or later discovered. As operational examples, the processor-based device may analyze the captured sound to detect an operational problem in the device that is not otherwise noticeable to a user of the device, and/or the processor-based device may analyze the captured sound to determine the root cause of an operational problem encountered by the device.

According to at least one embodiment, the device is operable to perform a primary function other than generating sound, but the device generates detectable sound as a by-product of its operation. In certain embodiments, the device may be configured to generate a distinctive sound upon occurrence of a particular operational problem. Of course, such generated sound may still be incidental to the operation of the device in performing some function other than generation of sound.

In at least one embodiment, a processor-based device is communicatively coupled to the acoustic capture sensor to receive captured sound and is also communicatively coupled to a data storage device that has empirical sound data stored therein. As examples, such empirical sound data may include known sound data for identifying a particular operational problem within a device and/or sound data for previous operation (or "normal" operation) of a device. In this manner, the processor-based device may compare of sound captured by acoustic capture sensor(s) within a device with the stored empirical sound data to analyze the device's operation. In at least one embodiment, the processor-based device is arranged remote from the device being evaluated. For instance, captured sound data from a device may be communicated via a communication network to a processor-based device to allow for remote evaluation of the device's operation.

Once the processor-based device processes the captured sound data for a device, it may generate output evaluating the device's operation, and such output may be communicated (e.g., displayed to a user on a display). For instance, output may specify whether a problem has been detected within a device, and/or output may identify the cause of an operational problem detected by the processor's analysis of the captured sound.

It should be recognized that a technical advantage of one aspect of at least one embodiment of the present invention is that acoustical analysis of a device's operation is robotically performed to obtain a detailed view of the device's operation. Such acoustical analysis may enable an increase in accuracy and efficiency in the analysis of a device's operation, which may aid in ensuring proper operation of a device during its production stage and proper troubleshooting of later arising operational problems within the device.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWING

For a more complete understanding of the present invention, reference is now made to the following descriptions taken in conjunction with the accompanying drawing, in which.

DETAILED DESCRIPTION

Figure 1:
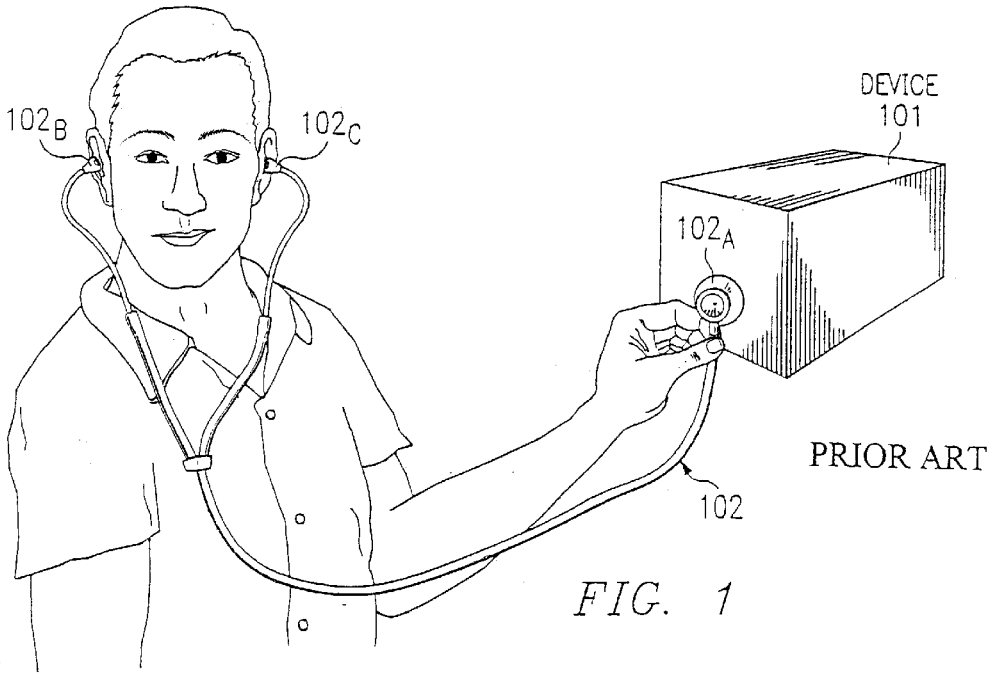
FIG. 1 shows an example of a technique for manually performing acoustic analysis of a device.

Turning to FIG. 1, an example of a technique for manually performing acoustic analysis of a device is shown. As shown, in this technique, a user may utilize acoustic capture device (e.g., stethoscope) 102 to manually listen to sounds generated by device 101 during its operation. More specifically, a user may place the sensor (e.g., microphone) 102A against device 101, and sounds captured by sensor 102A are transmitted to earpieces 102B and 102C. In this manner, the user may manually listen for sounds within device 101 and may analyze captured sounds to diagnose operational problems within the device. As an example, device 101 may be a paper handling device (e.g., paper sorter, stacker, stapler, etc. which may be implemented within a larger system, such as a photocopier or printer), in which distinctive sounds are made by the different operational components of such paper handling device (e.g., levers, motor, etc.). As another example, device 101 may be an automobile, in which the user may utilize acoustic capture device 102 to listen to sounds generated by the automobile (e.g., by its engine, transmission, radiator, braking system, etc.) in order to locate and/or evaluate such sounds. Thus, an experienced user may, over time, develop knowledge regarding various sounds encountered within device 101 to enable the user to determine from sounds captured by acoustic capture device 102 likely problems within the device.

It is often difficult for a technician (especially a technician relatively unfamiliar with sounds generated by a device) to perform manual analysis of captured sounds. That is, manual analysis of captured sounds of a device may not be sufficiently acute to properly detect an operational problem and/or determine the cause of an operational problem of a device. Variances in sounds may be so slight that they are unrecognizable to a technician, and/or a technician may fail to accurately identify a sound.

Figure 2:
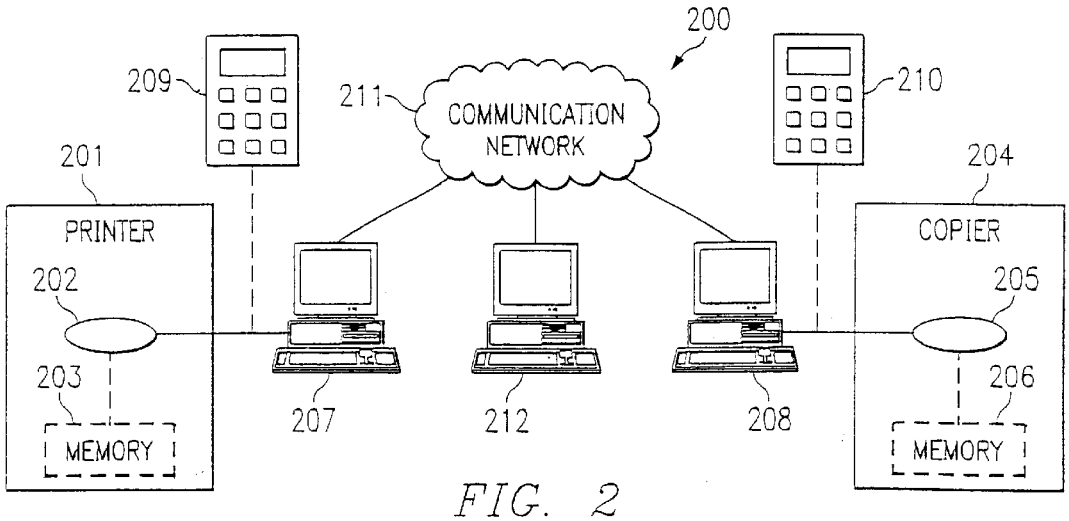
FIG. 2 shows an example of a technique for robotically performing acoustical analysis of a device in accordance with at least one embodiment of the present invention.

Turning now to FIG. 2, an example of a technique for robotically performing acoustical analysis of a device in accordance with at least one embodiment of the present invention is shown. More specifically, FIG. 2 shows a canonical system 200 that enables acoustic analysis of the operation of paper handling devices to be performed robotically. It should be understood, however, that the present invention is not intended to be limited solely to acoustic analysis of paper handling devices, but rather, various other embodiments may be implemented to enable acoustic analysis of other types of devices, including without limitation automobiles. System 200 includes a first device 201 (which is a printer in this example) and a second device 204 (which is a photocopier in this example). Printer 201 is communicatively coupled to a processor-based device 207 and/or 209, which may each be a personal computer (PC), laptop computer, or handheld computer, as examples. Similarly, photocopier 204 is communicatively coupled to such a processor-based device 208 and/or 210. While FIG. 2 shows printer 201 and photocopier 204 as coupled to separate processor-based devices, it should be understood that in some implementations multiple devices may be coupled to a common processor-based device. As further shown in FIG. 2, processor-based devices 207, 208, 209, and/or 210 may be communicatively coupled to communication network 211. Communication network 211 may be any type of communications network including, but not limited to, direct PC to PC connection, device to network connection (e.g., printer to network connection), a local area network (LAN), a wide area network (WAN), modem to modem connection, the Internet, an Intranet, an Extranet, a combination of the above, or any other communications network now known or later developed within the networking arts which permits two or more computers to communicate with each other. Furthermore, processor-based device 212 located remote from printer 201 and/or photocopier 204 may be communicatively coupled to communication network 211.

Printer 201 and photocopier 204 each include at least one acoustic capture sensor (e.g., microphone), such as sensors 202 and 205. Additionally, printer 201 and photocopier 204 may include memory 203 and 206, respectively, for storing acoustic data captured by sensors 202 and 205. Memory 203 and 206 is referred to broadly herein and is intended to encompass any suitable data storage mechanism, including without limitation random access memory (RAM), disk drive, floppy disk, optical disk, and other suitable data storage mechanisms.

In operation, sensor 202 captures sounds generated by printer 201 during its operation. In certain embodiments, sensor 202 may be implemented to perform analysis of the captured sound, such as relatively simple timing comparison of the captured sound. However, in other embodiments, sensor 202 may perform an analog-to-digital (A/D) conversion of the captured sounds, and may then communicate the captured sound data (in digital form) to at least one of processor-based devices 207, 209, and 212. As described in greater detail hereafter, such processor-based device may execute to analyze the captured sound data to evaluate the operation of printer 201. As one example, suppose a user is experiencing a problem with his/her printer 201. Sensor 202 may capture sound data during operation (e.g., attempted operation) of printer 201, and may communicate the captured sound data to processor-based device 207 (which may, for example, be a companion PC). For instance, the user may trigger sensor 202 to capture sound data and communicate such sound data to processor-based device 207 (e.g., by interacting with an interface on printer 201 and/or interacting with an interface provided by processor-based device 207), as an example. As a further example, sensor 202 may capture sound data each time that the printer is in operation (which may be stored, at least temporarily, to memory 203), and such captured sound data may be automatically communicated to processor-based device 207 or be communicated thereto in response to a triggering action (e.g., a user interacting with an interface of printer 201 or an interface of processor-based device 207). For instance, sound data may be captured during each operation of printer 201 and may be stored/buffered in memory 203. For example, memory 203 may have buffered the sound data of the previous 15 minutes of operation of printer 201, and upon an operational problem being detected by a user, the buffered sound data may be communicated to a processor-based device (e.g., device 207) for analysis thereof to determine the cause of the operational problem.

Alternatively, handheld device 209 may be coupled to printer 201 to receive captured sound data, and may execute to analyze the captured sound data to evaluate the operation of printer 201. For instance, handheld device 209 may be a portable device that a technician brings to a site when servicing printer 201. In this manner, handheld device 209 may be temporarily coupled to printer 201 to receive captured sound data from sensor 202. The capture of sensed data and/or the communication of such data to handheld device 209 may be triggered in any suitable manner, such as those described above in conjunction with processor-based device 207.

According to various embodiments of the present invention, computer 207 and handheld device 209 may interface to printer 201 via any suitable interface that enables communication of captured sound data from sensor 202. For instance, a dedicated interface may be provided for communication of such sound data from sensor 202 to computer 207 or 209, or an existing interface (e.g., parallel port interface) that is utilized to communicate print commands from computer 207 to printer 201 may be implemented to also communicate sound data from sensor 202 to computer 207. Additionally, the captured sound data may be communicated in many different ways, any of which are intended to be within the scope of the present invention. For instance, in certain implementations the captured sound data may be communicated as discrete data packages, while in other implementations such captured sound data may be streamed from the sensor 202 to a receiving device (e.g., computer 207 or device 209). The sound data itself may be raw data (i.e., as captured by sensor 202). Alternatively, the sound data may be (pre-)processed. For instance, only deviations of the captured signal from "normalized" information stored in memory 203 may be communicated to computer 207 or device 209.

In still a further alternative, processor-based device 212 may be capable of receiving captured sound data from printer 201 via communication network 211, and may execute to analyze the captured sound data to evaluate the operation of printer 201. For instance, processor-based device 212 may be located at a help desk remote from printer 201 and may receive captured sound data to enable remote evaluation of the operation of printer 201. The capture of sensed data and/or the communication of such data to processor-based device 212 may be triggered in any suitable manner, such as those described above in conjunction with processor-based device 207.

Acoustic analysis of photocopier 204 may be achieved in a manner similar to that described above for printer 201. More specifically, sound data may be captured by acoustic capture sensor (e.g., microphone) 205 during operation of photocopier 204, and such sound data may be communicated to one or more of processor-based devices 208, 210, and 212, which are operable to analyze the captured data to evaluate the operation of photocopier 204. It should be recognized that utilizing one or more of processor-based devices 207, 208, 209, 210, and 212 to robotically analyze captured sound data to evaluate the operation of printer 201 and photocopier 204 may aid in detection of operational problems (even before such problems are noticeable by a user) and/or determination of the root cause of operational problems. It should also be recognized that in this manner "robotically" means that such system is capable of analyzing captured sound data autonomously or with minimal human intervention. For instance, according to various embodiments of the present invention a system is disclosed that is capable of robotically evaluating the performance of a device based at least in part on captured acoustic data of the device.

Devices are available in the prior art for receiving sound produced by a musical instrument and indicating the note/tone of such sound in order to assist a user in properly tuning such musical instrument. An example of such a musical tuner is the product commercially known as the AutoStrobe™ 490-ST Strobe Tuner available from Peterson Tuning Equipment. In this manner, such musical tuners are utilized to assist a user in tuning the sound generated by a musical instrument to a proper tone. It should be recognized that musical instruments primarily function to generate sounds (i.e., musical tones). While various embodiments of the present invention may be implemented to robotically evaluate operation of musical instruments by analyzing captured sounds produced by the operation of such musical instruments, other embodiments are implemented to analyze sounds generated by the operation of devices, wherein the sounds analyzed are by-products of the operation of the devices (e.g., a secondary result), rather than such sound being the primary result of the operation of the devices. For example, one embodiment of the present invention may be utilized to analyze sounds that are generated during operation of a paper handling device. In this manner, such sounds are a by-product of the operation of the paper handling device, while the paper handling device has some other primary functionality (e.g., sorting paper, stacking paper, stapling paper, etc.). Thus, various embodiments of the present invention may be utilized to analyze incidental sounds that result from operation of a device (e.g., sounds that are incident to the device's operation) to evaluate the operation of the device.

According to certain embodiments of the present invention, a device may be implemented to produce a particular sound upon the occurrence of a certain problem. For instance, automobile brake systems commonly include tabs known as "chirpers" that produce a distinctive chirping sound as the brake pads wear indicating need for replacement of the pads. Similarly, various devices may be implemented in a manner such that operational problems produce a distinctive sound, which may aid a processor-based device in easily recognizing such distinctive sound as a particular operational problem. Thus, in certain embodiments incidental sounds (or by-product sounds) of a device operating to perform some primary function (e.g., a paper handling function) may be intentionally tailored to produce a distinctive sound upon occurrence of an operational problem. That is, devices may be intentionally designed such that operational problems result in the generation of a distinctive sound.

Figure 3:
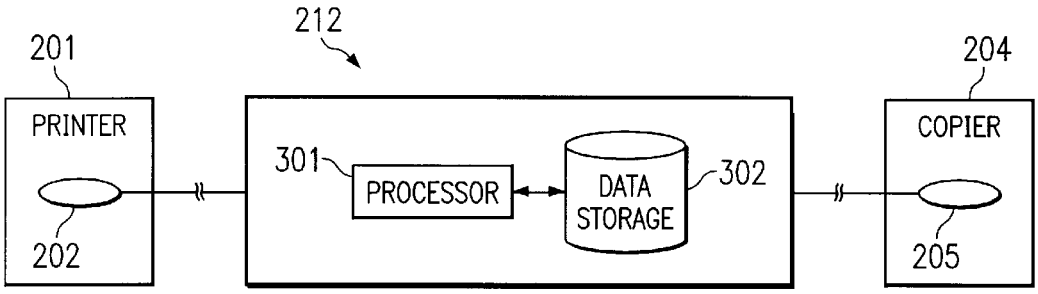
FIG. 3 shows an implementation of one embodiment of the present invention.

Turning now to FIG. 3, an implementation of one embodiment of the present invention is further shown with like reference numerals used to identify like components of FIG. 2. As described with FIG. 2 above and further shown in FIG. 3, printer 201 and photocopier 204 may be coupled to a processor-based device (such as devices 207, 208, 209, 210, and 212 of FIG. 2). FIG. 3 shows an example of such devices coupled to remote processor-based device 212. As shown, processor-based device 212 comprises processor 301, which may be any suitable processor now known or later developed, for example the Intel® Pentium® 4 microprocessor. Processor-based device 212 further comprises (or is communicatively coupled to) data storage device 302, which may include any suitable data storage mechanism, including without limitation random access memory (RAM), disk drive, floppy disk, optical disk, and other suitable data storage mechanisms.

According to at least one embodiment, data storage device 302 stores acoustic analyzing software that is executable by processor 301 to analyze sounds captured by sensors 202 and 205 to evaluate the operation of printer 201 and photocopier 204. In various other embodiments, any suitable acoustic analyzer now known or later developed may be implemented to perform the acoustic analysis of captured sounds. For instance, in certain embodiments an acoustic analyzer may be implemented that is capable of analyzing timing of a device (e.g., lever movements within a paper handling device). In other embodiments, an acoustic analyzer may be implemented that is capable of analyzing the frequency of captured sounds (e.g., frequency of sounds captured from the motor of a paper handling device or frequency of friction sounds captured from a paper handling device). As an example of one implementation within a paper handling device, after triggering a first acoustic sensor within a paper handling device (e.g., by paper entering a first lever of the device), timing can be taken until another sensor is reached (e.g., until another sensor detects sound of a second lever being reached). Such timing processing may be relatively simple, and may be performed within paper handling device itself in certain embodiments. As another example of an implementation within a paper handling device, a more sophisticated frequency analyzer may be utilized to detect deviating motor speeds or wear of rollers that have less friction, as examples.

Additionally, data storage device 302 may store acoustic data that such software may utilize for analyzing the captured sounds. That is, data storage device 302 stores an empirical data set relating to sounds that may be captured for a device (e.g., printer 201 and/or photocopier 204). For example, acoustic data may be stored in data storage device 302, and the software may execute to compare sounds captured from printer 201 and/or photocopier 204 with such stored acoustic data to evaluate the operation of printer 201 and/or photocopier 204. For instance, sounds of known operational problems may be stored in data storage device 302, and processor 301 may execute software to compare the sounds captured from printer 201 and/or photocopier 204 with such known problem sounds stored in data storage device 302. If a captured sound sufficiently matches a known problem sound, it may be determined that the device (e.g., printer 201 or photocopier 204) is experiencing the known problem for which the sound matches.

Once processor 301 executes to determine that the captured sound sufficiently matches the stored sound for a known operational problem, an indication of such problem may be communicated to a user/technician (e.g., by displaying such problem on a display associated with processor-based device 212), and a suggested action to take for resolving the identified problem may similarly be communicated. Alternatively, a comparison of the captured sound to the sounds of known problems may be communicated to a user/technician. For instance, processor-based device 212 may communicate to the user/technician that there was a 95% match with the sound for known problem A, a 80% match with the sound for known problem B, and a 42% match for known problem C. In this manner, the technician may determine that the operational problem of the device is most likely problem A because of its 95% match, but may instead be problem B having an 80% match. Furthermore, a graphical overlay of wave forms of the sound frequencies may be presented to the user/technician to allow the user/technician to compare the wave form of the captured sound with the wave form for sounds of known problems. Such wave form comparisons may be presented to the user/technician in order of nearest matches, for instance. In this manner, the processor-based device may analyze the captured sound to evaluate the operation of a device and may suggest a likely problem with the device, and may further provide support for its conclusion (or support for likely alternative problems) by presenting such comparison information to the user/technician. As new problems are detected for a device (for which sounds were not previously stored in data storage device 302), data storage device 302 may be updated to include the sounds for such newly detected problems to enable such problems to be robotically detected in the future.

As another example, normal operational sounds for devices may be stored in data storage device 302 against which captured sounds may be compared to determine whether a potential problem exists within a device or whether the device's operation sounds normal. For instance, historical sounds captured from printer 201 and/or photocopier 204 may be stored in data storage device 302, and processor 301 may execute software to compare captured sounds from such devices with their historical sounds to determine whether abnormal sounds are detected, which may be indicative of an operational problem with the device. In this manner, performance problems may be pro-actively detected before such problems are noticeable to a user, which may allow for such problems to be corrected before impacting the user. Of course, a certain amount of change in the sound may be acceptable for some devices. For instance, a device's sounds may normally change over time, e.g., due to change in temperature, normal wear of the device, etcetera. In various embodiments, processor 301 may detect abnormal changes in the sounds of a device, and/or may detect the point at which a normal change foreshadows a future problem (e.g., the point at which the device should be serviced to avoid future operational problems).

Furthermore, it should be understood that different sounds may be stored in data storage device for different devices. For example, sounds indicative of particular problems with printer 201 may be stored in data storage device 302, and sounds indicative of particular problems with photocopier 204 may be stored in data storage device 302. Software executing on processor 301 may compare sounds captured by sensor 202 (of printer 201) with the stored sound data for such printer, and the software may execute to compare sounds captured by sensor 205 (of photocopier 204) with the stored sound data for such photocopier.

Figure 4:
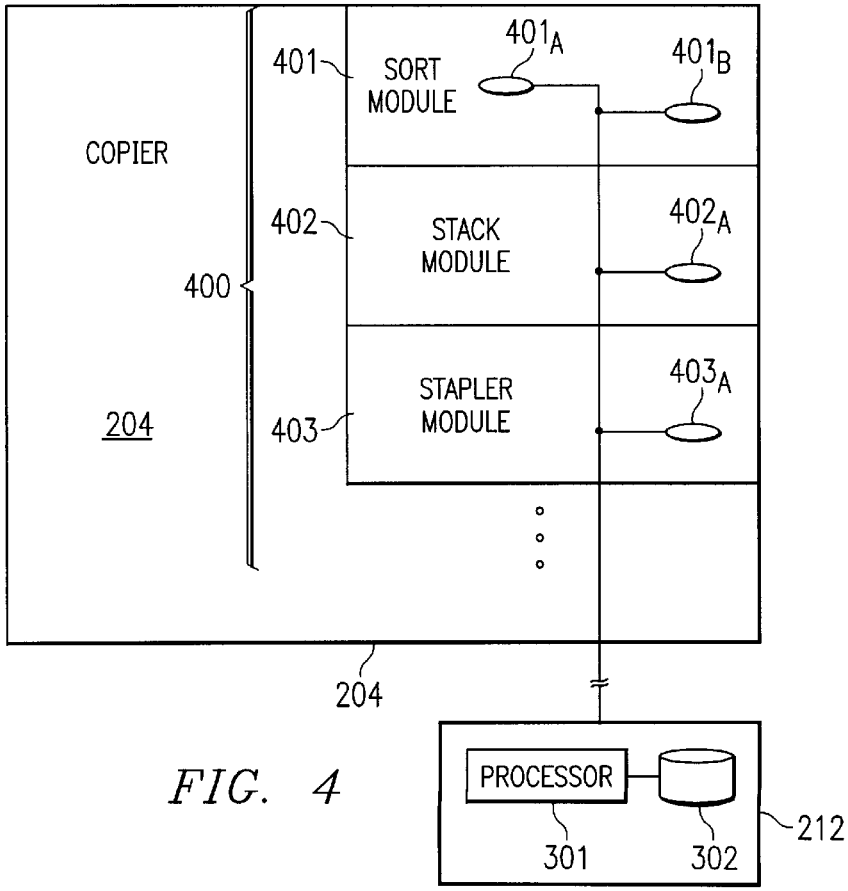
FIG. 4 shows an example of an implementation of a device having a plurality of different acoustic capture sensors implemented therein.

In view of the above, various embodiments of the present invention may allow for sound data to be captured from a plurality of different devices, and a processor-based system, such as processor-based device 212, may analyze the captured sound data to evaluate the operation of each of the plurality of different devices. Additionally, in various embodiments of the present invention, a plurality of acoustic capture sensors may be implemented within a single device, and sound data captured from such plurality of acoustic capture sensors may be robotically analyzed to evaluate the device's operation. For instance, FIG. 4 shows an example of an implementation of photocopier 204 being implemented having a plurality of different paper handling modules 400, such as sorting module 401, stacking module 402, and stapling module 403. Various acoustic capture sensors (e.g., microphones) may be implemented within paper handling modules 400. For example, sensors $\mathbf{401}_A$ and $\mathbf{401}_B$ are implemented within sorting module 401, sensor $\mathbf{402}_A$ is implemented within stacking module 402, and sensor $\mathbf{403}_A$ is implemented within stapling module 403. As shown in FIG. 4, sound data captured by any one or more of sensors $\mathbf{401}_A$, $\mathbf{401}_B$, $\mathbf{402}_A$, and $\mathbf{403}_A$ is communicated (e.g., via a communication bus and/or a communication network) to a processor-based device, such as processor-based device 212.

In this manner, processor-based device 212 may analyze the sound data from such sensors to identify the root cause of an operational problem. For example, processor-based device 212 may determine which, if any, of paper handling modules 400 is experiencing an operational problem. Additionally, as described above, the captured sound data from one or more of the sensors may be robotically analyzed in an attempt to determine the type of problem being encountered (e.g., the root cause of an operational problem). For instance, suppose paper is continually jamming within a paper handling device. Such paper jamming may be the result of many different causes (i.e., operational problems) within the device. Acoustic analysis of the device may allow for a determination that the cause of such paper jamming is that there is too much friction encountered when a sheet of paper passes through a particular lever of the device. Accordingly, the solution may be to simply replace the lever of the device. As described above, processor-based device 212 is located remote from printer 201 and photocopier 204. Thus, utilizing such processor-based device 212 to perform the acoustic analysis of printer 201 and/or photocopier 204, the determination may be made that a technician needs to service the device in a particular manner before going on site. Thus, for example, if a technician needs a particular part (such as a replacement lever, as in the above example), the technician can obtain the part before going on site to service the device, which may expedite resolution of the operational problem.

In view of the above, various embodiments of the present invention may enable acoustic analysis of by-product sounds generated during operation of a device to robotically evaluate the operation of the device. A very detailed understanding of a device's operation may be achieved through such acoustical analysis. For instance, within paper handling devices, very distinctive sounds may be recognized for identifying various portions of the devices' operation (e.g., levers lifting, gears turning, paper moving through different stages of the device, etcetera). Therefore, such acoustic analysis may aid in evaluating the operation of a device during production, as well as troubleshooting devices when problems later arise. Acoustic analysis may, in some cases, reduce the time required for testing devices during production (as well as reduce the amount of time required for troubleshooting later arising problems with a device). For example, in the prior art, testing of paper handling devices during production generally comprised feeding 1,000 to 10,000 pages through a device to monitor its operation. Acoustical analysis may allow for a detailed view of the device's operation to be obtained much more quickly, and therefore may drastically reduce the number of pages required to be fed through a device to ensure accurate testing. Furthermore, acoustical analysis of various embodiments of the present invention provides a relatively easy manner of testing/analyzing the operation of an overall system that comprises a plurality of modules, which may be performed in addition to the individual testing of each module.

While the examples shown and described above in conjunction with FIGS. 2–4 provide a separate processor-based device to which captured sound data from a device (e.g., printer or photocopier) is communicated for acoustical analysis, some embodiments of the present invention may include intelligence for performing such acoustical analysis within the device itself (e.g., within the printer or photocopier). Thus, for example, a device may include sensor(s) for capturing sound data and a processor for processing the captured sound to analyze the device's operation (e.g., by comparing the captured sound data with empirical data), and upon detecting/identifying an operational problem, the processor may execute to cause information to be communicated to a user of the device (e.g., via a display of the device) and/or may execute to cause information regarding the operational problem to be communicated to a remote location (e.g., via a communication network) to, for instance, request service for the device.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A system comprising:

at least one device operable to perform a function, wherein said at least one device generates sound incident to performing said function;

said at least one device including at least one sensor operable to capture said sound of said device;

processor operable to process said sound captured by said at least one sensor to analyze operation of said at least one device;

data storage device communicatively coupled to said processor, said data storage device storing empirical sound data, wherein said processor is operable to execute comparison of said sound captured by said at least one sensor with said emperical sound data to analyze the function of said at least one device.

2. The system of claim 1 wherein said processor is arranged remote from said at least one device, and wherein said sound captured by said at least one sensor is communicated to said at least one device via a communication network.

3. The system of claim 1 wherein said sensor is operable to convert said sound from analog to digital for processing by said processor.

4. The system of claim 2 wherein said at least one device is a paper handling device.

5. The system of claim 1 wherein said at least one device is configured to generate distinctive sound upon occurrence of a particular functional problem of said at least one device.

6. The system of claim 1 wherein said at least one device includes a plurality of sensors operable to capture said sound of said device.

7. The system of claim 6 wherein said processor is operable to process said sound captured by said plurality of sensors to analyze the function of said at least one device.

8. The system of claim 1 wherein said processor is operable to generate output identifying the cause of a functional problem of said at least one device detected by the processor's analysis of said sound captured by said at least one sensor, said output to be communicated to a user.

9. A system comprising:

at least one device operable to perform a function, wherein said at least one device generates sound incident to performing said function;

said least one device including at least one sensor operable to capture said sound of said device;

processor operable to process said sound captured by said at least one sensor to analyze the function of said at least one device; and data storage device communicatively coupled to said processor, said data storage device storing empirical sound data, wherein said empirical sound data includes known sound data identifying a particular functional problem.

10. A system comprising:

at least one device operable to perform a function, wherein said at least one device generates sound incident to performing said function;

said at least one device including at least one sensor operable to capture said sound of said device;

processor operable to process said sound captured by said at least one sensor to analyze the function of said at least one device; and data storage device communicatively coupled to said processor, said data storage device storing empirical sound data, wherein said empirical sound data includes sound data for previous functioning of said at least one device.

11. A method for performing acoustical analysis of the operation of a device, wherein said device is a paper handling device, said method comprising:

captured sound generated as a by-product of a primary function of said device, wherein said primary function is some function other than generating said sound; and robotically processing the captured sound to analyze said primary function of said device to determine whether said device is functioning properly.

12. The method of claim 11 wherein said robotically processing further comprises:

comparing the captured sound with stored empirical sound data.

13. The method of claim 12 wherein said empirical sound data includes one or more selected from the group consisting of:

known sound data identifying a particular functional problem with said device, and sound data for previous functioning of said at least one device.

14. A system for performing acoustical analysis of the operation of a paper handling device, said system comprising:

a paper handling device operable to perform a function other than generating sound;

at least one sound capture means for capturing sound generated by said paper handling device; and means for analyzing the sound captured by said at least one sound capture means to determine whether said paper handling device functioning properly in performing said function.

15. The system of claim 14 wherein the analyzing means comprises means for comparing the sound captured by said at least one sound capture means with stored empirical sound data.

16. The system of claim 14 wherein said at least one sound is generated as a by-product of said paper handling device performing said function other than generating sound.

17. The system of claim 14 wherein said function other than generating sound comprises a paper handling function.

18. The system of claim 17 wherein said paper handling function comprises at least one selected from the group consisting of:

feeding sheets of paper from one component to another component, stapling sheets of paper, sorting sheets of paper, and stacking sheets of paper.

19. The system of claim 14 wherein said paper handling device is included in at least one of the following:

photocopier and printer.

* * * * *